US008409308B2

(12) United States Patent
Sato et al.

(10) Patent No.: US 8,409,308 B2
(45) Date of Patent: Apr. 2, 2013

(54) PROCESS FOR MANUFACTURING POLISHING PAD

(75) Inventors: Akinori Sato, Osaka (JP); Junji Hirose, Osaka (JP); Kenji Nakamura, Osaka (JP); Takeshi Fukuda, Osaka (JP); Masato Doura, Osaka (JP)

(73) Assignee: Toyo Tire & Rubber Co., Ltd., Osaka-shi (JP)

( * ) Notice: Subject to any disclaimer, the term of this patent is extended or adjusted under 35 U.S.C. 154(b) by 206 days.

(21) Appl. No.: 12/601,725

(22) PCT Filed: May 15, 2008

(86) PCT No.: PCT/JP2008/058911

§ 371 (c)(1),
(2), (4) Date: Nov. 24, 2009

(87) PCT Pub. No.: WO2008/149650

PCT Pub. Date: Dec. 11, 2008

(65) Prior Publication Data

US 2010/0162631 A1 Jul. 1, 2010

(30) Foreign Application Priority Data

May 31, 2007 (JP) ..... 2007-145583

(51) Int. Cl.
*B24B 1/00* (2006.01)
*B24D 11/00* (2006.01)

(52) U.S. Cl. ..... 51/295; 451/28; 156/108; 428/38; 428/137; 428/138; 428/142

(58) Field of Classification Search ..... 51/295
See application file for complete search history.

(56) References Cited

U.S. PATENT DOCUMENTS 5,069,002 A 12/1991 Sandhu et al.
5,081,421 A 1/1992 Miller et al.
(Continued)

FOREIGN PATENT DOCUMENTS

JP 9-7985 1/1997
JP 10-83977 3/1998
(Continued)

OTHER PUBLICATIONS

International Search Report, mailed on Aug. 19, 2008, directed to counterpart International Patent Application No. PCT/JP2008/058911; 2 pages.

*Primary Examiner* — Kaj K Olsen
*Assistant Examiner* — Ross J Christie
(74) *Attorney, Agent, or Firm* — Morrison & Foerster LLP

(57) ABSTRACT

A method for manufacturing a polishing pad that has a high level of optical detection accuracy and is prevented from causing slurry leak from between the polishing region and the light-transmitting region includes preparing a cell-dispersed urethane composition by a mechanical foaming method; placing a light-transmitting region at a predetermined position on a face material or a belt conveyor, continuously discharging the cell-dispersed urethane composition onto a part of the face material or the belt conveyor where the light-transmitting region is not placed; placing another face material or belt conveyor on the discharged cell-dispersed urethane composition; curing the cell-dispersed urethane composition to form a polishing region including a polyurethane foam, so that a polishing sheet is prepared; applying a coating composition containing an aliphatic and/or alicyclic polyisocyanate to one side of the polishing sheet and curing the coating composition to form a water-impermeable film; and cutting the polishing sheet.

2 Claims, 3 Drawing Sheets

U.S. PATENT DOCUMENTS

| | | | | |
|---|---|---|---|---|
| 5,605,760 | A | 2/1997 | Roberts | |
| 5,893,796 | A | 4/1999 | Birang et al. | |
| 5,964,643 | A | 10/1999 | Birang et al. | |
| 6,045,439 | A | 4/2000 | Birang et al. | |
| 6,280,290 | B1 | 8/2001 | Birang et al. | |
| 6,358,130 | B1 | 3/2002 | Freeman et al. | |
| 6,439,968 | B1 * | 8/2002 | Obeng | 451/41 |
| 6,454,630 | B1 | 9/2002 | Tolles | |
| 6,524,164 | B1 | 2/2003 | Tolles | |
| 6,537,133 | B1 | 3/2003 | Birang et al. | |
| 6,676,717 | B1 | 1/2004 | Birang et al. | |
| 6,719,818 | B1 | 4/2004 | Birang et al. | |
| 6,876,454 | B1 | 4/2005 | Birang et al. | |
| 2001/0036805 | A1 | 11/2001 | Birang et al. | |
| 2003/0109197 | A1 | 6/2003 | Tolles | |
| 2003/0171070 | A1 | 9/2003 | Tolles | |
| 2003/0190867 | A1 | 10/2003 | Birang et al. | |
| 2003/0217517 | A1 * | 11/2003 | Allison et al. | 51/298 |
| 2004/0014395 | A1 | 1/2004 | Birang et al. | |
| 2004/0102141 | A1 * | 5/2004 | Swisher et al. | 451/41 |
| 2004/0106357 | A1 | 6/2004 | Birang et al. | |
| 2004/0203320 | A1 * | 10/2004 | Hosaka et al. | 451/6 |
| 2004/0209066 | A1 * | 10/2004 | Swisher et al. | 428/313.5 |
| 2004/0224611 | A1 * | 11/2004 | Aoi et al. | 451/6 |
| 2005/0170751 | A1 | 8/2005 | Birang et al. | |
| 2005/0245171 | A1 * | 11/2005 | Hosaka et al. | 451/6 |
| 2006/0014476 | A1 | 1/2006 | Birang et al. | |
| 2006/0154568 | A1 | 7/2006 | Tolles | |
| 2006/0183412 | A1 * | 8/2006 | Allison et al. | 451/526 |
| 2007/0015441 | A1 | 1/2007 | Birang et al. | |
| 2007/0021037 | A1 | 1/2007 | Birang et al. | |
| 2007/0021045 | A1 * | 1/2007 | Swisher et al. | 451/527 |
| 2007/0066195 | A1 | 3/2007 | Duong | |
| 2007/0254564 | A1 * | 11/2007 | Song et al. | 451/64 |
| 2008/0063856 | A1 * | 3/2008 | Duong | 428/317.9 |
| 2008/0188163 | A1 | 8/2008 | Duong | |
| 2008/0227367 | A1 | 9/2008 | Birang et al. | |
| 2008/0305720 | A1 | 12/2008 | Hirose et al. | |
| 2009/0093202 | A1 * | 4/2009 | Fukuda et al. | 451/533 |
| 2009/0253353 | A1 * | 10/2009 | Ogawa et al. | 451/41 |

FOREIGN PATENT DOCUMENTS

| | | | |
|---|---|---|---|
| JP | 11-512977 | | 11/1999 |
| JP | 2001-291686 | | 10/2001 |
| JP | 2003-510826 | | 3/2003 |
| JP | 2004-169038 | | 6/2004 |
| JP | 2004-343090 | | 12/2004 |
| JP | 2005-210143 | | 8/2005 |
| JP | 2006-159386 | | 6/2006 |
| JP | 2006-187838 | | 7/2006 |
| JP | 2007-61929 | | 3/2007 |
| JP | 2007-88464 | | 4/2007 |
| JP | 2007284619 | A * | 11/2007 |
| JP | 2008100331 | A * | 5/2008 |
| JP | 2008100473 | A * | 5/2008 |
| JP | 2008101089 | A * | 5/2008 |
| WO | WO 2006062158 | A1 * | 6/2006 |
| WO | WO 2007119875 | A1 * | 10/2007 |
| WO | WO 2008047631 | A1 * | 4/2008 |

* cited by examiner

PROCESS FOR MANUFACTURING POLISHING PAD

REFERENCE TO RELATED APPLICATIONS

This application is a national stage application under 35 USC 371 of International Application No. PCT/JP2008/058911, filed May 15, 2008 which claims the priority of Japanese Patent Application No. 2007-145583, filed May 31, 2007, the contents of both of which prior applications are incorporated herein by reference.

FIELD OF THE INVENTION

The present invention relates to a method for production of a polishing pad by which the planarizing processing of optical materials such as lenses, reflecting mirrors and the like, silicon wafers, glass substrates for hard disks, aluminum substrates, and materials requiring a high degree of surface planarity such as those in general metal polishing processing can be carried out stably with high polishing efficiency. The polishing pad of the present invention is used particularly preferably in a process of planarizing a silicone wafer, and a device having an oxide layer, a metal layer or the like formed on a silicon wafer, before lamination and formation of the oxide layer, the metal layer or the like.

BACKGROUND OF THE INVENTION

Production of a semiconductor device involves a step of forming an electroconductive film on the surface of a wafer to form a wiring layer by photolithography, etching etc., a step of forming an interlaminar insulating film on the wiring layer, etc., and an uneven surface made of an electroconductive material such as metal and an insulating material is generated on the surface of a wafer by these steps. In recent years, processing for fine wiring and multilayer wiring is advancing for the purpose of higher integration of semiconductor integrated circuits, and accordingly techniques of planarizing an uneven surface of a wafer have become important.

As the method of planarizing an uneven surface of a wafer, a CMP method is generally used. CMP is a technique wherein while the surface of a wafer to be polished is pressed against a polishing surface of a polishing pad, the surface of the wafer is polished with an abrasive in the form of slurry having abrasive grains dispersed therein (hereinafter, referred to as slurry). As shown in FIG. 1, a polishing apparatus used generally in CMP is provided for example with a polishing platen 2 for supporting a polishing pad 1, a supporting stand (polishing head) 5 for supporting a polished material (wafer) 4, a backing material for uniformly pressurizing a wafer, and a mechanism of feeding an abrasive. The polishing pad 1 is fitted with the polishing platen 2 for example via a double-sided tape. The polishing platen 2 and the supporting stand 5 are provided with rotating shafts 6 and 7 respectively and are arranged such that the polishing pad 1 and the polished material 4, both of which are supported by them, are opposed to each other. The supporting stand 5 is provided with a pressurizing mechanism for pushing the polished material 4 against the polishing pad 1.

Conventionally, such a polishing pad is manufactured by a batch method such as (1) a method including casting a resin material into a mold to form a resin block and slicing the resin block with a slicer, (2) a method including casting a resin material into a mold and pressing the resin material to form a thin sheet, or (3) a method including melting a raw resin material and extruding the melt from a T die to form a sheet directly.

A method of continuously producing a polyurethane-polyurea polishing sheet material is also proposed to prevent variations in hardness, cell size or the like, which would otherwise be caused by batch production methods (Patent Literature 1). Specifically, this method includes mixing raw materials for polyurethane, a fine powder with particle sizes of 300 μm or less, and an organic foaming agent, discharging and casting the mixture into the space between a pair of endless surface belts, then performing a polymerization reaction of the mixture using heating means, and separating the resulting sheet-shaped product from the surface belts so that a polishing sheet material is obtained.

When CMP is conducted, there is a problem of judging the planarity of wafer surface. That is, the point in time when desired surface properties or planar state are reached should be detected. With respect to the thickness of an oxide film, polishing speed etc., the polishing treatment of a test wafer has been conducted by periodically treating the wafer, and after the results are confirmed, a wafer serving as a product is subjected to polishing treatment.

In this method, however, the treatment time of a test wafer and the cost for the treatment are wasteful, and a test wafer and a product wafer not subjected to processing are different in polishing results due to a loading effect unique to CMP, and accurate prediction of processing results is difficult without actual processing of the product wafer.

Accordingly, there is need in recent years for a method capable of in situ detection of the point in time when desired surface properties and thickness are attained at the time of CMP processing, in order to solve the problem described above. While various methods are used for such detection, an optical detection method using a film thickness monitoring mechanism with a laser beam, which is incorporated in a rotary platen, is becoming the mainstream in view of measurement accuracy or spatial resolution in non-contact measurement (Patent Literatures 2 and 3).

The optical detection means is specifically a method of detecting the endpoint of polishing by irradiating a wafer via a polishing pad through a window (light-transmitting region) with a light beam, and monitoring an interference signal generated by reflection of the light beam.

In such method, the endpoint is determined by knowing an approximate depth of surface unevenness by monitoring a change in the thickness of a surface layer of a wafer. When such change in thickness becomes equal to the thickness of unevenness, the CMP process is finished. As a method of detecting the endpoint of polishing by such optical means and a polishing pad used in the method, various methods and polishing pads have been proposed.

A polishing pad having, as least a part thereof, a solid and uniform transparent polymer sheet passing a light of wavelengths of 190 to 3500 nm therethrough is disclosed (Patent Literature 4). Further, a polishing pad having a stepped transparent plug inserted into it is disclosed (Patent Literature 5). A polishing pad having a transparent plug on the same surface as a polishing surface is disclosed (Patent Literature 6).

Besides, a proposal is also offered for preventing a slurry from leaking out an interface (joint line) between a polishing region and a light-transmitting region (Patent Literatures 7 and 8). However, the techniques of Patent Literatures 7 and 8 have a problem in which the transparent sheet or the fluid-impermeable layer may be easily separated due to slurry infiltration during polishing, because it is bonded to the polishing layer with a double-sided tape.

There is also disclosed a method for manufacturing a polishing pad, which includes placing a rod or plug of a first resin in a liquid of a second resin, curing the second resin to prepare a formed product, and slicing the formed product to form a polishing pad having a light-transmitting region and a polishing region integrated together (Patent Literature 9). In this manufacturing method, the light-transmitting region and the polishing region are integrated with each other, so that slurry leak can be prevented to some extent.

In the case of the manufacturing method of Patent Literature 9, however, voids (pores) can be formed at the interface between the first and second resins in the process of placing a rod or plug of the first resin in a liquid of the second resin, so that a slurry may leak through the voids. In addition, the method of Patent Literature 9 cannot be used to produce a long polishing pad.

Patent Literature 1: JP-A 2004-169038

Patent Literature 2: U.S. Pat. No. 5,069,002

Patent Literature 3: U.S. Pat. No. 5,081,421

Patent Literature 4: JP-A National Publication (Laid-Open) No. 11-512977

Patent Literature 5: JP-A 9-7985

Patent Literature 6: JP-A 10-83977

Patent Literature 7: JP-A 2001-291686

Patent Literature 8: JP-A National Publication (Laid-Open) No. 2003-510826

Patent Literature 9: JP-A 2005-210143

SUMMARY OF THE INVENTION

As a result of investigations to solve the above problems, the inventors have made the invention based on the finding that the object can be achieved using the polishing pad manufacturing method described below.

The invention is directed to a method for manufacturing a polishing pad, including the steps of: preparing a cell-dispersed urethane composition by a mechanical foaming method; placing a light-transmitting region at a predetermined position on a face material or a belt conveyor, while feeding or moving the face material or the belt conveyor; continuously discharging the cell-dispersed urethane composition onto a part of the face material or the belt conveyor where the light-transmitting region is not placed; placing another face material or belt conveyor on the discharged cell-dispersed urethane composition; curing the cell-dispersed urethane composition to form a polishing region including a polyurethane foam, while its thickness is controlled to be uniform, so that a polishing sheet is prepared; applying a polyurethane resin coating composition containing an aliphatic and/or alicyclic polyisocyanate to one side of the polishing sheet and curing the polyurethane resin coating composition to form a water-impermeable film; and cutting the polishing sheet.

The manufacturing method allows continuous production of a polishing sheet having a light-transmitting region and also allows polishing pad production with high productivity. According to the manufacturing method, the light-transmitting region and the polishing region are integrally formed so that a slurry is less likely to leak from between the light-transmitting region and the polishing region during polishing. In addition, the water-impermeable film provided on one side (the back surface) of the polishing sheet can completely prevent slurry leak. The water-impermeable film is made of a polyurethane resin containing an aliphatic and/or alicyclic polyisocyanate and therefore has a high level of light transmittance and flexibility. Therefore, the water-impermeable film has no adverse effect on the optical detection accuracy and produces the advantage that a long polishing pad produced therewith can be easily wound. The resulting polishing sheet may be used alone as a polishing pad, or a cushion layer may be placed on one side of the resulting polishing sheet to form a laminated polishing pad.

The water-impermeable film preferably has a thickness of 20 to 100 μm. If the thickness of the water-impermeable film is less than 20 μm, the slurry leak-preventing effect may be reduced. If the thickness is more than 100 μm, the light transmittance may be degraded, or the rigidity may be increased so that the winding ability may tend to be low.

DETAILED DESCRIPTION OF THE INVENTION

Figure 1:
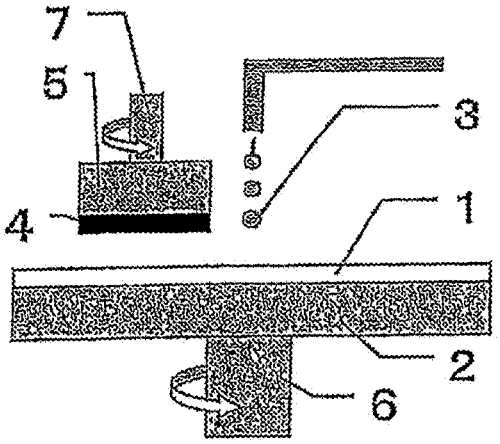
Fig.1 PRIOR ART
FIG. 1 is a schematic configuration diagram showing an example of a polishing apparatus for use in CMP polishing.

In an embodiment of the invention, the polishing region includes a polyurethane foam having fine cells, which may be formed by curing a cell-dispersed urethane composition. Polyurethane is particularly preferred as polishing region-forming materials, because polyurethane resin is excellent in abrasion resistance and polymers with desired physical properties can be easily obtained by varying the raw material composition.

The polyurethane comprises an isocyanate component, a polyol component (high-molecular-weight polyol, low-molecular-weight polyol etc.) and a chain extender.

As the isocyanate component, a compound known in the field of polyurethane can be used without particular limitation. The isocyanate component includes, for example, aromatic diisocyanates such as 2,4-toluene diisocyanate, 2,6-toluene diisocyanate, 2,2'-diphenyl methane diisocyanate, 2,4'-diphenyl methane diisocyanate, 4,4'-diphenyl methane diisocyanate, 1,5-naphthalene diisocyanate, p-phenylene diisocyanate, m-phenylene diisocyanate, p-xylylene diisocyanate and m-xylylene diisocyanate, aliphatic diisocyanates such as ethylene diisocyanate, 2,2,4-trimethyl hexamethylene diisocyanate and 1,6-hexamethylene diisocyanate, and cycloaliphatic diisocyanates such as 1,4-cyclohexane diisocyanate, 4,4'-dicyclohexyl methane diisocyanate, isophorone diisocyanate and norbornane diisocyanate. These may be used alone or as a mixture of two or more thereof.

As the isocyanate component, it is possible to use not only the above-described diisocyanate compounds but also multifunctional (trifunctional or more) polyisocyanates. As the multifunctional isocyanate compounds, a series of diisocyanate adduct compounds are commercially available as Desmodul-N (Bayer) and Duranate™ (Asahi Chemical Industry Co., Ltd.).

As the high-molecular-weight polyol, those usually used in the art of polyurethane can be exemplified. Examples thereof include polyether polyols represented by polytetramethylene ether glycol and polyethylene glycol; polyester polyols represented by polybutylene adipate; polyester polycarbonate polyols exemplified by reaction products of polyester glycol such as polycaprolactone polyol or polycaprolactone and alkylene carbonate; polyester polycarbonate polyols obtained by reacting ethylene carbonate with polyvalent alcohol and the reacting the resultant reaction mixture with an organic dicarboxylic acid; and polycarbonate polyols obtained by ester exchange reaction between polyhydroxyl compound and aryl carbonate. These may be used singly or in combination of two or more kinds.

Besides the above high-molecular-weight polyol described in the above as a polyol component, it is preferred to concomitantly use a low-molecular-weight polyol such as ethyleneglycol, 1,2-propylene glycol, 1,3-propylene glycol, 1,4-butanediol, 1,6-hexanediol, neopentylglyol, 1,4-cyclohexanedimethanol, 3-methyl-1,5-pentanediol, diethyleneglycol, triethyleneglycol, and 1,4-bis(2-hydroxyethoxy)benzene. Low-molecular-weight polyamine such as ethylenediamine, tolylenediamine, diphenylmethanediamine, and diethylenetriamine may be used.

The ratio between the amounts of the high-molecular-weight polyol and the low-molecular-weight polyol in the polyol components may be determined depending on the desired characteristics of the polishing region to be produced with the polyols.

In the case where a polyurethane foam is produced by means of a prepolymer method, a chain extender is used in curing of a prepolymer. A chain extender is an organic compound having at least two active hydrogen groups and examples of the active hydrogen group include: a hydroxyl group, a primary or secondary amino group, a thiol group (SH) and the like. Concrete examples of the chain extender include: polyamines such as 4,4'-methylenebis(o-chloroaniline) (MOCA), 2,6-dichloro-p-phenylenediamine, 4,4'-methylenebis(2,3-dichloroaniline), 3,5-bis(methylthio)-2,4-toluenediamine, 3,5-bis(methylthio)-2,6-toluenediamine, 3,5-diethyltoluene-2,4-diamine, 3,5-diethyltoluene-2,6-diamine, trimethylene glycol-di-p-aminobenzoate, polytetramethylene oxide-di-p-aminobenzoate, 4,4'-diamino-3,3',5,5'-tetraethyldiphenylmethane, 4,4'-diamino-3,3'-diisopropyl-5,5'-dimethyldiphenylmethane, 4,4'-diamino-3,3',5,5'-tetraisopropyldiphenylmethane, 1,2-bis(2-aminophenylthio)ethane, 4,4'-diamino-3,3'-diethyl-5,5'-dimethyldiphenylmethane, N,N'-di-sec-butyl-4,4'-diaminophenylmethane, 3,3'-diethyl-4,4'-diaminodiphenylmethane, m-xylylenediamine, N,N'-di-sec-butyl-p-phenylenediamine, m-phenylenediamine and p-xylylenediamine; low-molecular-weight polyol; and a low-molecular-weight polyamine. The chain extenders described above may be used either alone or in mixture of two kinds or more.

A ratio between an isocyanate component, a polyol component and a chain extender can be altered in various ways according to molecular weights thereof, desired physical properties of polishing region and the like. In order to obtain polishing region with desired polishing characteristics, a ratio of the number of isocyanate groups in an isocyanate component relative to a total number of active hydrogen groups (hydroxyl groups+amino groups) in a polyol component and a chain extender is preferably in the range of from 0.80 to 1.20 and more preferably in the range of from 0.99 to 1.15. When the number of isocyanate groups is outside the aforementioned range, there is a tendency that curing deficiency is caused, required specific gravity and hardness are not obtained, and polishing property is deteriorated.

Manufacture of a polyurethane foam is enabled by means of either a prepolymer method or a one shot method, of which preferable is a prepolymer method in which an isocyanate-terminated prepolymer is synthesized from an isocyanate component and a polyol component in advance, with which a chain extender is reacted since physical properties of an obtained polyurethane is excellent.

The polyurethane foam may be produced by curing a cell-dispersed urethane composition that is prepared by mixing a first component containing an isocyanate group containing compound with a second component containing an active hydrogen group containing compound. In the prepolymer method, an isocyanate-terminated prepolymer serves as an isocyanate group containing compound and a chain extender serves as an active hydrogen group containing compound. In the one shot method, an isocyanate component serves as an isocyanate group containing compound, and a chain extender and a polyol component combined serves as an active hydrogen group containing compound.

The cell-dispersed urethane composition is prepared by a mechanical foaming method (including a mechanical frothing method). In particular, the mechanical foaming method is preferably performed using an active hydrogen group-free silicone-based surfactant including a copolymer of polyalkylsiloxane and polyether. Preferred examples of such a silicone-based surfactant include SH-192 and L-5340 (manufactured by Dow Corning Toray Silicone Co., Ltd). The content of the silicone-based surfactant in the polyurethane foam is preferably from 0.05 to 5% by weight. If the silicone-based surfactant content is less than 0.05% by weight, fine-cellular foams may be less likely to be produced. If the content is more than 5% by weight, the plasticizing effect of the silicone-based surfactant may tend to inhibit the production of high-hardness polyurethane foams.

Various additives may be mixed; such as a stabilizer including an antioxidant, a lubricant, a pigment, a filler, an antistatic agent and others.

Description will be given of an example of a method of preparing a cell-dispersed urethane composition below. A method of preparing such a cell-dispersed urethane composition has the following steps:

1) a foaming step of preparing a cell dispersion liquid of an isocyanate-terminated prepolymer (first component), wherein a silicone-based surfactant is added into an isocyanate-terminated prepolymer, which is agitated in the presence of a non-reactive gas to thereby disperse the non-reactive gas into the prepolymer as fine cells and obtain a cell dispersion liquid. In a case where the prepolymer is solid at an ordinary temperature, the prepolymer is preheated to a proper temperature and used in a molten state.
2) a curing agent (chain extender) mixing step, wherein a chain extender (second component) is added into the cell dispersion liquid, which is agitated to thereby obtain a cell-dispersed urethane composition.

The non-reactive gas used for forming fine cells is preferably not combustible, and is specifically nitrogen, oxygen, a carbon dioxide gas, a rare gas such as helium and argon, and a mixed gas thereof, and the air dried to remove water is most preferable in respect of cost.

As a stirrer for dispersing the silicone-based surfactant-containing first component to form fine cells with the non-reactive gas, known stirrers can be used without particular limitation, and examples thereof include a homogenizer, a dissolver, a twin-screw planetary mixer etc. The shape of a stirring blade of the stirrer is not particularly limited either, but a whipper-type stirring blade is preferably used to form fine cells.

A known catalyst to promote the polyurethane reaction, such as a tertiary amine catalyst, may be added to the cell-dispersed urethane composition. The type and content of the catalyst may be selected taking into account the casting time for which the cell-dispersed urethane composition is cast into a mold after the mixing process or taking into account the curing time after the discharge of the composition onto the face material or the like.

A light transmittance of a light-transmitting region is preferably 40% or more and more preferably 50% or more at a wavelength over all the range of from 300 to 800 nm in wavelength.

No specific limitation is imposed on a material of which the light-transmitting region is made, but a light transmittance thereof is preferably 40% or more and more preferably 50% or more at a wavelength over all the range of from 300 to 800 nm in wavelength. Examples of such a material of the light-transmitting region include: thermoset resins such as a polyurethane resin, a polyester resin, a phenol resin, a urea resin, a melamine resin, an epoxy resin and an acrylic resin; thermoplastic resins such as a polyurethane resin, a polyester resin, a polyamide resin, a cellulose-based resin, an acrylic resin, a polycarbonate, a halogen containing resin (polyvinyl chloride, polytetrafluoroethylene, polyvinylidene fluoride and the like), a polystyrene and an olefinic resin (polyethylene, polypropylene and the like); light curable resins curable with irradiation of light such as ultraviolet and an electron beam; and photosensitive resins. The resins may be used either alone or in combination of two or more kinds.

For example, the light-transmitting region may be formed by an extrusion molding method or a cast molding method. Alternatively, a cylindrical or columnar resin block may be produced from the material and then cut into a light-transmitting region of the desired shape using a cutting blade of a specific shape. A long light-transmitting region may be formed by spiral cutting.

The light-transmitting region may have a long shape or a short strip shape and be shaped depending on the desired shape of the polishing pad (such as a long shape or a circular shape). The long light-transmitting region generally has a length of about 5 m, preferably 8 m or more. The height of the light-transmitting region is generally from about 0.5 to about 3 mm, preferably from 0.8 to 2 mm, while it may be appropriately adjusted in relation to the polishing region.

The hardness of the light-transmitting region is preferably, but not limited to, from 30 to 60 degrees, more preferably from 30 to 50 degrees in Asker D hardness. If it is less than 30 degrees, the light-transmitting region may be easily deformed so that it may be difficult to optically detect the end point. If it is more than 60 degrees, the surface of the object being polished may tend to be easily scratched.

In an embodiment of the invention, examples of the face material to be used include, but are not limited to, a sheet of paper, a cloth, a nonwoven fabric, and a resin film. In particular, the face material is preferably a resin film having both heat resistance and flexibility.

Examples of the resin used to form the face material include polyethylene terephthalate, polyester, polyethylene, polypropylene, polystyrene, polyimide, polyvinyl alcohol, polyvinyl chloride, fluororesins such as polyfluoroethylene, nylon, and cellulose.

In view of strength, winding ability and so on, the thickness of the face material is preferably, but not limited to, from about 20 to about 200 μm. The width of the face material is preferably, but not limited to, from about 60 to about 250 cm, taking into account the desired size of the polishing pad.

The surface of the face material has preferably undergone release treatment, so that the process of separating the face material can be easily performed after the polishing sheet is prepared.

Figure 2:
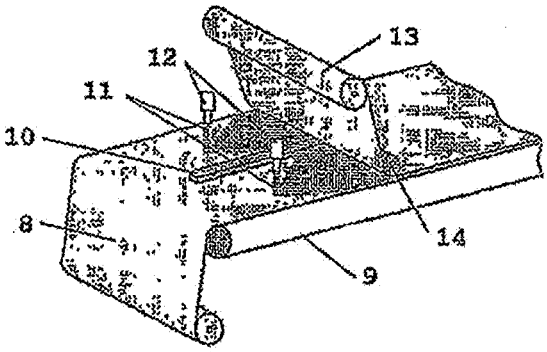
FIG. 2 is a schematic diagram showing an example of a production step of a long polishing pad according to the invention.

The method of the invention for manufacturing a polishing pad is further described below. FIG. 2 is a schematic diagram showing an example of the polishing pad manufacturing process of the invention.

A face material 8 is fed from a roll and transported on a belt conveyor 9. Alternatively, a release-treated belt conveyor 9 may be used without using the face material 8. A light-transmitting region 10 is fed from a roll or the like to be placed at a predetermined position on the face material 8 or the belt conveyor 9. One or more light-transmitting regions 10 may be provided on the face material 8 or the belt conveyor 9 at the substantial center or predetermined intervals. However, if too many light-transmitting regions 10 are provided, the area of the polishing region to be involved in the polishing becomes relatively small, which is not preferred in view of polishing characteristics. For example, therefore, when the face material 8 or the belt conveyor 9 to be used has a width of about 60 to about 100 cm, the number of the light-transmitting regions 10 is preferably from one to three. A long light-transmitting region 10 is continuously placed as shown in FIG. 2. On the other hand, short strip-shaped light-transmitting regions are intermittently placed.

The cell-dispersed urethane composition 11 is then continuously discharged from the discharge nozzle of a mixing head 12 onto a part of the face material 8 or the belt conveyor 9 where the light-transmitting region 10 is not placed. The moving speed of the face material 8 or the belt conveyor 9 or the amount of the cell-dispersed urethane composition 11 to be discharged may be appropriately controlled taking the thickness of the polishing layer into account.

Another face material 13 or belt conveyor (not shown) is then placed on the discharged cell-dispersed urethane composition 11. While its thickness is controlled to be uniform, the cell-dispersed urethane composition 11 is cured to form a polishing region of a polyurethane foam, so that a long polishing sheet is obtained. For example, means for controlling the thickness to be uniform may be a roll 14 such as a nip roll or a coater roll, a doctor blade, or the like. For example, the cell-dispersed urethane composition 11 may be cured by allowing it to pass through a heating oven (not shown) placed on the belt conveyor, after the thickness is controlled to be uniform. The heating temperature may be from about 40 to about 100° C., and the heating time may be about 5 to about 10 minutes. The cell-dispersed urethane composition 11 may be allowed to react until it does not flow and then subjected to heating or post-curing. This process is effective in improving the physical properties of the polyurethane foam.

The resulting long polishing sheet is typically cut into a roll of a several meter piece using a cutting machine. The length of the piece is generally from about 5 to about 10 m, while it may be appropriately controlled depending on the polishing apparatus. Post-curing and the step of separating the face material are generally performed after the cutting. However, post-curing and the step of separating the face material may be performed before the cutting. The post-curing may be performed before or after the face material is separated. Since the face material and the polishing sheet generally differ in thermal shrinkage, the post-curing is preferably performed after the separation of the face material in order to prevent deformation of the polishing sheet. After the post-curing, the end portion of the polishing sheet may be removed by cutting so that the length and the thickness can be adjusted and made uniform, respectively.

For example, the resulting long polishing sheet may be subjected to primary cutting with a cutting machine so that a piece having a shape slightly larger than the desired shape (such as a circle, a square, or a rectangle) can be obtained. The cut piece may then be subjected to post-curing and the step of separating the face material. The post-curing and the step of separating the face material are generally performed after the cutting. However, the post-curing and the step of separating the face material may be performed before the cutting. The cutting should be performed in such a manner that the light-transmitting region can be located at a predetermined position in the polishing sheet. The post-curing may be performed before or after the face material is separated. Since the face material and the polishing sheet generally differ in thermal shrinkage, the post-curing is preferably performed after the separation of the face material in order to prevent deformation of the polishing sheet. After the post-curing, the polishing sheet may be subjected to secondary cutting so that a piece having the desired shape can be obtained. When a circular piece is formed by cutting, its diameter may be from about 50 to about 200 cm, preferably from 50 to 100 cm.

An average cell diameter of a polyurethane foam is preferably in the range of from 30 to 80 μm and more preferably in the range of from 30 to 60 μm. If an average cell diameter falls outside the range, a tendency arises that a polishing rate is decreased and a planarity of an object to be polished (a wafer) after polishing is reduced.

The thickness of the polishing region is generally, but not limited to, from about 0.8 to about 4 mm, preferably from 1.2 to 2.5 mm.

Preferably, the polishing region has a specific gravity ranging from 0.5 to 1.0. When the specific gravity is less than 0.5, the surface strength of the polishing region decreases, so that the planarity of the polished substance tends to decrease. When the specific gravity is larger than 1.0, the fine cell number on the surface of the polishing region decreases, so that the polishing rate tends to decrease despite excellent planarity.

Preferably, the polishing region has a hardness measured by ASKER D hardness meter, ranging from 45 to 65 degrees. When the ASKER D hardness is less than 45 degrees, the planarity of the polished substance decreases, while when the hardness is more than 65 degrees, the uniformity of the polished substance tends to decrease despite excellent planarity.

The scatter of the thickness of the polishing sheet is preferably 100 μm or less. When the scatter of the thickness is higher than 100 μm, large undulation is caused to generate portions different in a contacting state with an object of polishing, thus adversely influencing polishing characteristics. To solve the scatter of the thickness of the polishing layer, the surface of the polishing layer is dressed generally in an initial stage of polishing by a dresser having abrasive grains of diamond deposited or fused thereon, but the polishing layer outside of the range described above requires a longer dressing time to reduce the efficiency of production.

The method for reducing range of the thickness of the polishing sheet may include buffing the surface of the polishing sheet with a buffing machine. The buffing is preferably performed in a stepwise manner with abrasive materials different in particle size.

In the invention, the polishing surface of the polishing sheet, which is brought into contact with a substance to be polished (wafer), preferably has projections and recesses for holding and replacing a slurry. The polishing surface of the polishing region made of a foam has a lot of openings which function to hold and replace a slurry. If projections and recesses are formed on the polishing surface, a slurry can be more efficiently held and replaced so that the destruction of the substance to be polished caused by adsorption of the slurry on the substance can be prevented. The projections and recesses may be not limited, as long as they can serve to hold and replace a slurry. For example, examples of forms of the projections and recesses include XY lattice grooves, concentric grooves, through holes, non-through holes, polygonal columns, cylindrical columns, spiral grooves, eccentric grooves, radial grooves, or any combination thereof. In general, the projections and recesses are regularly formed. However, the groove pitch, the groove width, the groove depth, and the like may be changed per every certain range in order to hold and replace a slurry in a desired manner.

The method of forming the projection and recess structure is not particularly limited, and for example, formation by mechanical cutting with a jig such as a bite of predetermined size, formation by casting and curing resin in a mold having a specific surface shape, formation by pressing resin with a pressing plate having a specific surface shape, and formation by a laser light using a $CO_2$ gas laser or the like.

In the invention, a polyurethane resin coating composition containing an aliphatic and/or alicyclic polyisocyanate is applied to one side (the back surface) of the polishing sheet and cured to form a water-impermeable film, when a polishing layer is formed. The water-impermeable film may be formed before or after the cutting of the long polishing sheet.

A one- or two-component polyurethane resin coating composition containing an aliphatic and/or alicyclic polyisocyanate as an isocyanate component may be used as the polyurethane resin coating composition without any particular limitations. The use of the aliphatic and/or alicyclic polyisocyanate allows the formation of a water-impermeable film having a high level of light transmittance and flexibility.

Examples of the aliphatic polyisocyanate include ethylene diisocyanate, 2,2,4-trimethylhexamethylene diisocyanate, 1,6-hexamethylene diisocyanate (HDI), and so on. These may be used alone, or two or more of these may be used in combination.

Examples of the alicyclic polyisocyanate include 1,4-cyclohexane diisocyanate, 4,4'-dicyclohexylmethane diisocyanate, isophorone diisocyanate, norbornane diisocyanate, and so on. These may be used alone, or two or more of these may be used in combination.

The aliphatic or alicyclic polyisocyanate may be modified into a biuret, adduct or isocyanurate form or may be a prepolymer.

The water-impermeable film should be formed in such a manner that at least the contact area between the polishing region and the light-transmitting region can be covered with the water-impermeable film. In order to prevent slurry leak completely, the water-impermeable film is preferably formed over one side of the polishing sheet.

The thickness of the water-impermeable film is preferably from 20 to 100 μm, more preferably from 20 to 60 μm.

The hardness of the water-impermeable film is preferably lower than the hardness of the light-transmitting region in view of the winding ability of the long polishing pad, and it is preferably from 20 to 50 degrees, more preferably from 20 to 40 degrees in Asker D hardness.

In order to make high-accuracy optical detection of the end point possible, the water-impermeable film preferably has a light transmittance of 30% or more, more preferably 40% or more, over the wavelength range of 300 to 800 nm.

The polishing layer preferably has a bending elastic modulus of 120 MPa or less, more preferably 100 MPa or less. If the bending elastic modulus is more than 120 MPa, the polishing pad may tend to be difficult to wind up when it has a long shape.

In an embodiment of the invention, the polishing pad may be the polishing layer alone or a laminate of the polishing layer and any other layer (such as a cushion layer or an adhesive layer).

The cushion layer compensates for characteristics of the polishing layer. The cushion layer is required for satisfying both planarity and uniformity which are in a tradeoff relationship in CMP. Planarity refers to flatness of a pattern region upon polishing a wafer having fine unevenness generated upon pattern formation, and uniformity refers to the uniformity of the whole of a wafer. Planarity is improved by the characteristics of the polishing layer, while uniformity is improved by the characteristics of the cushion layer. The cushion layer used in the polishing pad of the present invention is preferably softer than the polishing region.

The material forming the cushion layer is not particularly limited, and examples of such material include a nonwoven fabric such as a polyester nonwoven fabric, a nylon nonwoven fabric or an acrylic nonwoven fabric, a nonwoven fabric impregnated with resin such as a polyester nonwoven fabric impregnated with polyurethane, polymer resin foam such as polyurethane foam and polyethylene foam, rubber resin such as butadiene rubber and isoprene rubber, and photosensitive resin.

For example, means for bonding the polishing layer and the cushion layer together may be implemented by a method including stacking the polishing layer and the cushion layer with a double-sided tape interposed therebetween and pressing them. It is preferred that the cushion layer should not be provided on the portion where the light-transmitting region is located.

The double-sided tape may have a general structure including a substrate of a nonwoven fabric, a film or the like and adhesive layers provided on both sides of the substrate. In terms of preventing infiltration of a slurry into the cushion layer, a film is preferably used as the substrate. For example, the adhesive layer may include a rubber-based adhesive, an acrylic-based adhesive, or the like. In view of metal ion content, the acrylic-based adhesive is preferred, because its metal ion content is relatively low.

A polishing pad of the invention may be provided with a double-sided tape on the surface of the pad adhered to a platen. As the double-sided tape, a tape of a common construction can be used in which adhesive layers are, as described above, provided on both surfaces of a substrate. As the substrate, for example, a nonwoven fabric or a film is used. Preferably used is a film as a substrate since separation from the platen is necessary after the use of a polishing pad. As a composition of an adhesive layer, for example, a rubber-based adhesive or an acrylic-based adhesive is exemplified. Preferable is an acrylic-based adhesive because of less of metal ions in content to which consideration is given.

A semiconductor device is produced through the step of polishing the surface of a semiconductor wafer with the long polishing pad. The semiconductor wafer generally includes a silicon wafer, and a metal wiring and an oxide film formed thereon. The method and apparatus for polishing the semiconductor wafer are not particularly limited. For example, the semiconductor wafer may be polished by the method described below.

Figure 3:
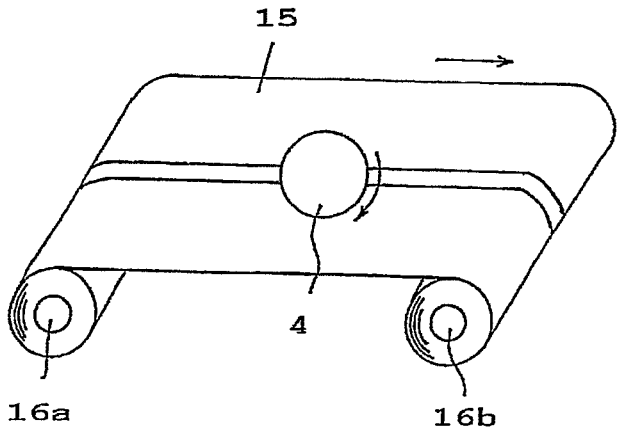
FIG. 3 is a schematic diagram showing a method of polishing a semiconductor wafer with a web-type polishing apparatus.

FIG. 3 is a schematic diagram showing a method of polishing a semiconductor wafer with a web-type polishing apparatus. First, a long polishing pad 15 is mainly wound on a supply roll 16*a*. A large number of semiconductor wafers 4 are then polished with the polishing pad. As the polishing pad in the used region is wound up on a take-up roll 16*b*, the polishing pad in a virgin region is fed from the supply roll 16*a*.

Figure 4:
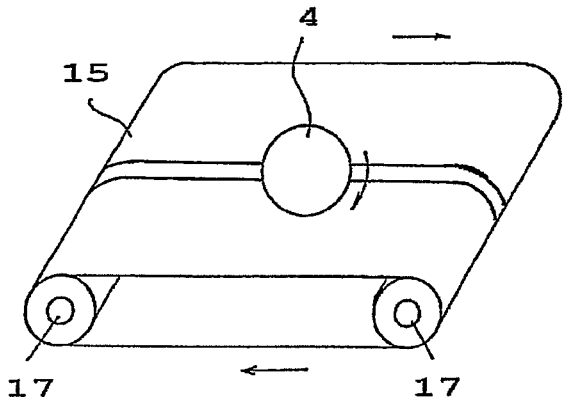
FIG. 4 is a schematic diagram showing a method of polishing a semiconductor wafer with a linear-type polishing apparatus.

FIG. 4 is a schematic diagram showing a method of polishing a semiconductor wafer with a linear-type polishing apparatus. A long polishing pad 15 is provided in the form of a belt so as to travel around rolls 17. Semiconductor wafers 4 are polished one after another on the linearly-moving polishing pad.

Figure 5:
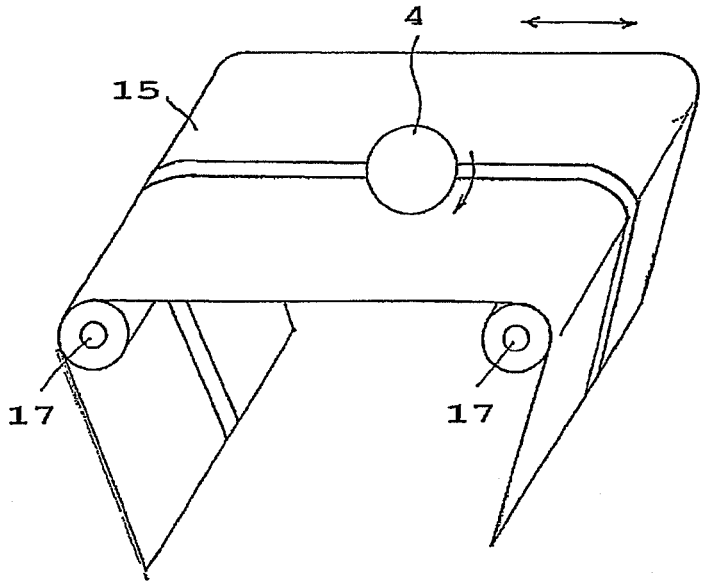
FIG. 5 is a schematic diagram showing a method of polishing a semiconductor wafer with a reciprocating polishing apparatus.

FIG. 5 is a schematic diagram showing a method of polishing a semiconductor wafer with a reciprocating polishing apparatus. A long polishing pad 15 is provided in the form of a belt so as to reciprocate between rolls 17. Semiconductor wafers 4 are polished one after another on the polishing pad, which is reciprocating between a left most position and a right most position.

Although not shown in the drawings, the polishing apparatus generally includes a polishing platen for supporting the long polishing pad, a support (polishing head) for supporting the semiconductor wafer, a backing material for uniformly pressing the wafer, and a polishing agent (slurry) feeding mechanism. The polishing platen and the support are so arranged that the long polishing pad and the semiconductor wafer supported thereby, respectively, can face each other, and the support has a rotary shaft. In the polishing process, the semiconductor wafer on the rotating support is pressed against the long polishing pad and polished with a slurry being fed. The flow rate of the slurry, the polishing load, the wafer rotation number, and so on are not particularly limited and may be controlled as appropriate.

A semiconductor device is fabricated after operation in a step of polishing a surface of a semiconductor wafer with the circular polishing pad. No specific limitation is imposed on a polishing method of a semiconductor wafer or a polishing apparatus, and polishing is performed with a polishing apparatus equipped, as shown in FIG. 1, with a polishing platen 2 supporting a polishing pad 1, a polishing head 5 holding a semiconductor wafer 4, a backing material for applying a uniform pressure against the wafer and a supply mechanism of a polishing agent 3. The polishing pad 1 is mounted on the polishing platen 2 by adhering the pad to the platen with a double-sided tape. The polishing platen 2 and the polishing head 5 are disposed so that the polishing pad 1 and the semiconductor wafer 4 supported or held by them oppositely face each other and provided with respective rotary shafts 6 and 7. A pressure mechanism for pressing the semiconductor wafer 4 to the polishing pad 1 is installed on the polishing head 5 side. During polishing, the semiconductor wafer 4 is polished by being pressed against the polishing pad 1 while the polishing platen 2 and the polishing head 5 are rotated and a slurry is fed. No specific limitation is placed on a flow rate of the slurry, a polishing load, a polishing platen rotation number and a wafer rotation number, which are properly adjusted.

Protrusions on the surface of the semiconductor wafer 4 are thereby removed and polished flatly. Thereafter, a semiconductor device is produced therefrom through dicing, bonding, packaging etc. The semiconductor device is used in an arithmetic processor, a memory etc.

EXAMPLES

Description will be given of the invention with examples, while the invention is not limited to description in the examples.

Measurement of Asker D Hardness

The measurement was performed according to JIS K6253-1997. Pieces of a size of 2 cm×2 cm (arbitrarily thick) cut from the light-transmitting region were used as hardness measurement samples. A water-impermeable film was produced from each of the polyurethane resin coating compositions used in Examples 1 and 2 and Comparative Example 1 and then cut into pieces of a size of 2 cm×2 cm (arbitrarily thick), which were also used as hardness measurement samples. The PET substrate used in Comparative Example 2 was cut into pieces of a size of 2 cm×2 cm (arbitrarily thick), which were also used as hardness measurement samples. These hardness measurement samples were allowed to stand in an environment at a temperature of 23° C.±2° C. and a humidity of 50%±5% for 16 hours. An at least 6 mm-thick laminate of each type of samples was used in the measurement. The hardness of the laminate was measured using a hardness meter (Asker D hardness meter, manufactured by KOBUNSHI KEIKI CO., LTD.).

Evaluation of Light Transmittance of Water-Impermeable Film and PET Substrate

A water-impermeable film was produced from each of the polyurethane resin coating compositions used in Examples 1 and 2 and Comparative Example 1 and then cut into a piece of a size of 10 mm×50 mm (1 mm in thickness), which was used as a light transmittance measurement sample. The PET substrate used in Comparative Example 2 was cut into a piece of a size of 10 mm×50 mm, which was also used as a light transmittance measurement sample. Each sample was placed in a glass cell (10 mm in optical wavelength, 10 mm in optical path width, 45 mm in height, manufactured by Sogo Laboratory Glass Works Co., Ltd.) filled with ultrapure water, and the light transmittance of the sample was measured at wavelengths of 300 to 800 nm using a spectrophotometer (UV-1600PC, manufactured by Shimadzu Corporation). The measured light transmittance was converted into a light transmittance per 1 mm thickness according to the Lambert-Beer law, and the evaluation was performed according to the following criteria.

○: The light transmittance was 30% or more over the wavelength range of 300 to 800 nm.

x: The light transmittance was less than 30% at least a certain wavelength in the range of 300 to 800 nm.

Measurement of Bending Elastic Modulus

The prepared polishing pad was cut into a 10 mm wide, 30 mm long sample piece. The bending elastic modulus of the sample piece was measured using a measurement system (5864 Desktop Tester System, manufactured by Instron Corporation) under the following conditions: the fulcrum-to-fulcrum distance of the bending strength measurement tool, 22 mm; crosshead speed, 0.6 mm/minute; displacement, 4 mm.

Evaluation of Occurrence of Peeling (Separation)

The prepared polishing pad (700 mm wide, 8 m long) was wound on a 50 mmϕ cylindrical tube, and whether or not peeling (separation) occurred between the polishing sheet and the water-impermeable film or the PET substrate was observed and evaluated according to the following criteria.

○: Peeling (separation) was not observed.

x: Peeling (separation) was observed.

Preparation Example

Preparation of Cell-Dispersed Urethane Composition

A mixture of 32 parts by weight of toluene diisocyanate (a mixture of 2,4-diisocyanate/2,6-diisocyanate=80/20), 8 parts by weight of 4,4'-dicyclohexylmethane diisocyanate, 54 parts by weight of polytetramethylene glycol (1006 in number average molecular weight), and 6 parts by weight of diethylene glycol was prepared. The mixture was stirred and heated at 80° C. for 120 minutes so that an isocyanate-terminated prepolymer (2.1 meq/g in isocyanate equivalent) was prepared. 100 parts by weight of the isocyanate-terminated prepolymer and 3 parts by weight of a silicone-based surfactant (SH-192 manufactured by Dow Corning Toray Silicone Co., Ltd.) were mixed to form a mixture, and the temperature of the mixture was controlled to be 80° C. In a mixing chamber, 80 parts by weight of the mixture and 20 parts by weigh of 4,4'-methylenebis(o-chloroaniline) (Iharacuamine MT manufactured by Ihara Chemical Industry Co., Ltd.) molten at 120° C. were mixed. At the same time, air was dispersed into the mixture by mechanical stirring so that a cell-dispersed urethane composition was prepared.

Preparation of Light-Transmitting Region

To a vessel were added 770 parts by weight of 1,6-hexamethylene diisocyanate and 230 parts by weight of 1,3-butanediol, and stirred and heated at 80° C. for 120 minutes, so that an isocyanate-terminated prepolymer was prepared. At 80° C., 29 parts by weight of polytetramethylene glycol with a number average molecular weight of 650, 13 parts by weight of trimethylolpropane and 0.43 parts by weight of a catalyst (Kao No. 25, manufactured by Kao Corporation) were mixed and stirred to form a liquid mixture. 100 parts by weight of the isocyanate-terminated prepolymer was added to the liquid mixture having a controlled temperature of 80° C. The mixture was thoroughly stirred using a hybrid mixer (manufactured by KEYENCE CORPORATION) and then degassed. The resulting reaction liquid was added dropwise onto a release-treated mold. The reaction liquid on the mold was covered with a release-treated PET film, and its thickness was controlled using a nip roll. The mold was then placed in an oven at 100° C. and subjected to post-curing for 16 hours, so that a polyurethane resin sheet (150 mm wide, 1.4 mm thick, 8 m long) was obtained. The polyurethane resin sheet was cut in a width of 10 mm with a cutting blade so that a long light-transmitting region (45 degrees in D hardness) was obtained.

Preparation of Long Polishing Sheet

The long light-transmitting region was placed on the center of a polyethylene terephthalate (PET) face material (50 μm thick, 100 cm wide), while the face material was being fed. The cell-dispersed urethane composition was then continuously discharged onto a part of the face material where the long light-transmitting region was not placed. The cell-dispersed urethane composition was then covered with another PET face material (50 μm thick, 100 cm wide), and its thickness was controlled to be uniform using a nip roll. The composition was then cured by heating at 80° C. to form a long polishing region of a polyurethane foam, so that a long polishing sheet was obtained. The polishing sheet was then cut in a length of 7 m, and the face materials were separated. The resulting sheet was subjected to post-curing at 110° C. for 6 hours. The surface of the polishing sheet was then buffed using a buffing machine (manufactured by AMITEC Corporation) so that its thickness was adjusted to 1.27 mm. The polishing surface of the long polishing sheet was then grooved using a grooving machine (manufactured by Toho Koki Co., Ltd.).

Example 1

A liquid mixture was obtained by mixing and stirring 7 parts by weight of 1,4-butanediol, 7 parts by weight of trimethylolpropane, 21.1 parts by weight of polytetramethylene glycol with a number average molecular weight of 650, and 0.6 parts by weight of a catalyst (Kao No. 25, manufactured by Kao Corporation). 100 parts by weight of an HDI prepolymer (Coronate 2612, manufactured by Nippon Polyurethane Industry Co., Ltd.) was added to the liquid mixture. The mixture was thoroughly stirred using a hybrid mixer and then degassed, so that a polyurethane resin coating composition was prepared. The polyurethane resin coating composition was applied to the whole of the back surface of the prepared long polishing sheet and cured by heating at 70° C. to form a water-impermeable film (20 μm in thickness, 20 degrees in D hardness), so that a long polishing pad was obtained.

Example 2

A liquid mixture was obtained by mixing and stirring 12.6 parts by weight of 1,4-butanediol, 3.4 parts by weight of trimethylolpropane, 6.9 parts by weight of polytetramethylene glycol with a number average molecular weight of 650, and 0.6 parts by weight of a catalyst (Kao No. 25, manufactured by Kao Corporation). 100 parts by weight of an HDI prepolymer (Coronate 2612, manufactured by Nippon Polyurethane Industry Co., Ltd.) was added to the liquid mixture. The mixture was thoroughly stirred using a hybrid mixer and then degassed, so that a polyurethane resin coating composition was prepared. The polyurethane resin coating composition was applied to the whole of the back surface of the prepared long polishing sheet and cured by heating at 70° C. to form a water-impermeable film (40 μm in thickness, 39 degrees in D hardness), so that a long polishing pad was obtained.

Comparative Example 1

A liquid mixture was obtained by mixing and stirring 2.9 parts by weight of trimethylolpropane, 56 parts by weight of polytetramethylene glycol with a number average molecular weight of 650, 59 parts by weight of PCL 305 (manufactured by DAICEL CHEMICAL INDUSTRIES, LTD.), 30 parts by weight of PCL 205 (manufactured by DAICEL CHEMICAL INDUSTRIES, LTD.), and 0.05 parts by weight of a catalyst (Kao No. 25, manufactured by Kao Corporation). 100 parts by weight of 4,4'-diphenylmethane diisocyanate was added to the liquid mixture. The mixture was thoroughly stirred using a hybrid mixer and then degassed, so that a polyurethane resin coating composition was prepared. The polyurethane resin coating composition was applied to the whole of the back surface of the prepared long polishing sheet and cured by heating at 70° C. to form a water-impermeable film (20 μm in thickness, 40 degrees in D hardness), so that a long polishing pad was obtained.

Comparative Example 2

A PET substrate (75 μm in thickness) was bonded to the whole of the back surface of the prepared long polishing sheet with a double-sided tape (Double Tack Tape, manufactured by SEKISUI CHEMICAL CO., LTD.) interposed therebetween, so that a long polishing pad was obtained.

TABLE 1

| | Evaluation of light transmittance | Bending elastic modulus (MPa) | Evaluation of peeling (separation) |
|---|---|---|---|
| Example 1 | ○ | 85.2 | ○ |
| Example 2 | ○ | 98.4 | ○ |
| Comparative Example 1 | x | 95.7 | ○ |
| Comparative Example 2 | x | 132.4 | x |

Table 1 shows that the polishing pad according to the invention has a high level of optical detection accuracy, is less likely to cause peeling (separation) when wound on a cylindrical tube, and is easy to wind up. The water-impermeable film of the polishing pad according to the invention can completely prevent slurry leak.

The invention claimed is:

1. A method for manufacturing a polishing pad, comprising the steps of:

preparing a cell-dispersed urethane composition by a mechanical foaming method;

placing a light-transmitting region at a predetermined position on a face material or a belt conveyor, while feeding or moving the face material or the belt conveyor;

continuously discharging the cell-dispersed urethane composition onto a part of the face material or the belt conveyor where the light-transmitting region is not placed;

placing another face material or another belt conveyor on the discharged cell-dispersed urethane composition;

curing the cell-dispersed urethane composition to form a polishing region comprising a polyurethane foam, while its thickness is controlled to be uniform, so that a polishing sheet is prepared;

applying, after removing the face material or the belt conveyor from the polishing sheet, a polyurethane resin coating composition containing an aliphatic and/or alicyclic polyisocyanate to a side of the polishing sheet from which the face material or the belt conveyor is removed and curing the polyurethane resin coating composition to form a water-impermeable film; and cutting the polishing sheet.

2. The method of claim 1, wherein the water-impermeable film has a thickness of 20 μm to 100 μm.

* * * * *